US011107420B2

(12) United States Patent
Hong et al.

(10) Patent No.: US 11,107,420 B2
(45) Date of Patent: Aug. 31, 2021

(54) DISPLAY DEVICE

(71) Applicant: LG Display Co., Ltd., Seoul (KR)

(72) Inventors: Seokhyun Hong, Suwon-si (KR); Jaeyoon Bae, Seoul (KR); OSung Do, Paju-si (KR); Taeyoung Lee, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 436 days.

(21) Appl. No.: 15/814,174

(22) Filed: Nov. 15, 2017

(65) Prior Publication Data

US 2018/0144689 A1 May 24, 2018

(30) Foreign Application Priority Data

Nov. 21, 2016 (KR) ..... 10-2016-0154805

(51) Int. Cl.
*G09G 3/32* (2016.01)
*G09G 3/3291* (2016.01)
(Continued)

(52) U.S. Cl.
CPC ..... *G09G 3/3291* (2013.01); *G09G 3/3233* (2013.01); *G09G 3/3258* (2013.01);
(Continued)

(58) Field of Classification Search
CPC .. G09G 3/3291; G09G 3/3275; G09G 3/3258; G09G 3/3233; G09G 2320/0295;
(Continued)

(56) References Cited

U.S. PATENT DOCUMENTS 9,076,387 B1 * 7/2015 Lee ..... G09G 3/20
2009/0027377 A1 * 1/2009 Kwon ..... G09G 3/3233 345/214

(Continued)

FOREIGN PATENT DOCUMENTS

CN 105321455 A 2/2016
CN 105702208 A 6/2016
KR 10-2015-0073694 A 7/2015

OTHER PUBLICATIONS

Extended European Search Report, dated Mar. 29, 2018 for the European patent application No. 17202761.7.

(Continued)

*Primary Examiner* — Lunyi Lao
*Assistant Examiner* — Jarurat Suteerawongsa
(74) *Attorney, Agent, or Firm* — Polsinelli PC

(57) ABSTRACT

The display device according to the present disclosure may comprise a display panel equipped with a plurality of pixels connected to data lines and sensing lines; a source drive IC configured to provide a data voltage to a pixel through the sensing line and equipped with a sensing block obtaining sensing data related to driving characteristics of the pixel using a signal input through the sensing line; a switch configured to control a connection via the sensing line between the pixel and the sensing block; and a power source configured to provide a test voltage or a test current to the sensing block, and the source drive IC may obtain calibration data for the sensing block by using the test voltage or the test current in a state that the switch disconnects the pixel and the sensing block.

17 Claims, 6 Drawing Sheets

(51) Int. Cl.

| | |
|---|---|
| ***G09G 3/3275*** | (2016.01) |
| ***G09G 3/3233*** | (2016.01) |
| ***G09G 3/3258*** | (2016.01) |
| *G09G 3/00* | (2006.01) |
| *G09G 3/36* | (2006.01) |

(52) U.S. Cl.
CPC ..... *G09G 3/3275* (2013.01); *G09G 3/006* (2013.01); *G09G 3/3659* (2013.01); *G09G 2300/043* (2013.01); *G09G 2310/0294* (2013.01); *G09G 2320/0233* (2013.01); *G09G 2320/0295* (2013.01); *G09G 2320/045* (2013.01); *G09G 2320/0693* (2013.01)

(58) Field of Classification Search
CPC ..... G09G 2310/0294; G09G 2320/045; G09G 2320/0233; G09G 2320/0693; G09G 2300/043; G09G 3/3659; G09G 3/006; G09G 3/3208; G09G 3/32; G09G 2310/027; G09G 3/30; G09G 3/20; H01L 51/50; G06F 3/042
See application file for complete search history.

(56) References Cited

U.S. PATENT DOCUMENTS

| | | | | |
|---|---|---|---|---|
| 2011/0157133 | A1* | 6/2011 | Ogura | G09G 3/20 345/211 |
| 2013/0050292 | A1* | 2/2013 | Mizukoshi | G09G 3/3291 345/690 |
| 2014/0176622 | A1 | 6/2014 | Jung et al. | |
| 2015/0379909 | A1* | 12/2015 | Yu | G09G 3/3258 345/690 |
| 2016/0012798 | A1* | 1/2016 | Oh | G09G 3/325 345/205 |
| 2016/0314739 | A1* | 10/2016 | Huang | G09G 3/3233 |

OTHER PUBLICATIONS

Chinese Office Action dated Jun. 11, 2020 issued in corresponding Patent Application No. 201711077700.0 w/English translation (16 pages).

* cited by examiner

DISPLAY DEVICE

CROSS-REFERENCE TO RELATED APPLICATION

This application claims the benefit of priority under 35 U.S.C. § 119(a) to Korean Patent Application No. 10-2016-0154805 filed on Nov. 21, 2016, which is incorporated by reference herein in its entirety.

BACKGROUND

Field of the Disclosure

The present disclosure relates to a display device, and more particularly to a display device that calibrates a sensing circuit for sensing characteristics of a display panel in real-time.

Description of the Background

An active matrix type organic light emitting display includes an organic light emitting diode (hereinafter, referred to as "OLED") which emits light by itself, and has advantages of a fast response speed, high light emitting efficiency, high brightness, and a wide viewing angle.

An OLED that emits light by itself includes an anode electrode, a cathode electrode, and organic compound layers formed therebetween. The organic compound layers include a hole injection layer HIL, a hole transport layer HTL, an emission layer EML, an electron transport layer ETL, and an electron injection layer EIL. When a driving voltage is applied to the anode electrode and the cathode electrode, holes passing through the HTL and electrons passing through the ETL are transferred to the EML to form excitons. As a result, the light emitting layer EML generates visible light.

In an organic light emitting diode display device, pixels each including an OLED are arranged in a matrix form, and luminance is controlled by controlling the amount of emitted light of the OLED according to the gradation of image data. Each of the pixels includes a driving element, i.e., a driving thin film transistor TFT, which controls the pixel current flowing the OLED according to the voltage applied between the gate electrode and the source electrode. The electrical characteristics of the OLED and the driving TFT deteriorate with time and may cause a difference in the pixels. Electrical deviations between these pixels are a major factor in degrading image quality.

The external compensation technology is to measure the sensing information corresponding to the electrical characteristics of the pixels (e.g., the threshold voltage and the electron mobility of the driving TFT and the threshold voltage of the OLED) and modulate image data in an external circuit based on the sensing information, in order to compensate for the electrical characteristic deviation between the pixels.

In this external compensation technology, the electrical characteristics of pixels are sensed by using a sensing block embedded in a source drive IC (integrated circuit). The sensing block which receives pixel characteristic signals in the form of a current comprises a plurality of sensing units including a current integrator and a sample/holder, and an analog-to-digital converter ADC. The current integrator performs an integration of a pixel current input through a sensing channel to produce a sensed voltage. This sensed voltage is passed to the ADC through the sample/holder, and converted to digital sensing data by the ADC. A timing controller calculates a pixel compensation value for compensating for variations in the electrical characteristics of pixels based on the digital sensing data from the ADC, and corrects the input image data based on the pixel compensation value.

Since the organic light-emitting display comprises a plurality of source driver ICs for driving the display panel on an area basis in a segmented fashion, a plurality of sensing blocks, each embedded in each source drive IC, sense the pixels on the display panel area by area in a segmented fashion. When pixels are sensed in a segmented fashion by a plurality of sensing blocks, sensing accuracy may be low due to offset variations among the sensing blocks. Especially, the ADC inside the source drive IC changes in its characteristics depending on a temperature or surrounding environments, so the output of the ADC maintains a constant value to some degree at a certain range of a room temperature, but at a high temperature outside the room temperature, it changes to a value significantly different from that at the room temperature. This output characteristics of the ADC affect the pixel sensing data for the panel, causing a block dim phenomenon in which a difference in luminance is displayed between the areas where the source drive ICs are responsible when displaying an image.

FIG. 1 schematically illustrates a technique for performing a calibration to eliminate a block dim phenomenon caused by a change in ADC characteristics after shipment.

Due to the characteristic deviation of the ADCs included in the sensing blocks, offsets are different between the source drive ICs (or the sensing blocks). Before the display device is shipped, the offsets are measured through a separate process and reduced by compensation, so when the data of the same luminance is displayed, the luminance difference does not occur between the areas where the source drive ICs are responsible. However, after shipment, the ADC characteristics can be changed and the deviation between the offsets of the sensing blocks can be generated, so when displaying the data of a same luminance, a phenomenon occurs in which the luminance is not uniform between the areas where the source drive ICs are responsible and the luminance varies in a horizontal direction.

In order to solve the block-dim phenomenon, an offset deviation between the sensing blocks must be compensated first through a calibration process. In the calibration process, a test current or a test voltage V_reference is applied to each sensing block, the sensing data for calibration is obtained which reflects the change of the ADC characteristics, and a compensation value for calibrating which can compensate the offset deviation among the sensing blocks is calculated based on the sensing data for calibrating. The timing controller increases the accuracy of the compensation by referring to the compensation value for calibrating as well as the compensation value for pixel when correcting input image data.

FIG. 2 shows an operation of a display device in which a period during which a driving unit performs display driving and a period during which a sensing unit performs a calibrating operation and a sense driving are performed separately in the related art. The operation of correcting the offset differences among the sensing blocks is performed in a display-off period during which a display driving stops its operation, which is performed in a blank period or a power off sequence, and mainly in the power off sequence.

As described above, since the calibrating operation proceeds in the power-off sequence, it is difficult to properly reflect the characteristic change of the sensing block caused by the environmental change during the display driving, and there is a problem that the time required for the power off sequence becomes longer.

SUMMARY

The present disclosure has been made in view of the above circumstances and is to provide a display device capable of performing a calibrating operation while in real time reflecting on the environmental change occurring during a display driving.

The display device according to an aspect of the present disclosure includes a display panel equipped with a plurality of pixels connected to data lines and sensing lines; a source drive IC configured to provide a data voltage to a pixel through the sensing line and equipped with a sensing block obtaining sensing data related to driving characteristics of the pixel using a signal input through the sensing line; a switch configured to control a connection via the sensing line between the pixel and the sensing block; and a power source configured to provide a test voltage or a test current to the sensing block, and the source drive IC may obtain calibration data for the sensing block by using the test voltage or the test current in a state that the switch disconnects the pixel and the sensing block.

In another aspect of the present disclosure, a display device comprises a display panel having a plurality of pixels connected to a data line and a sensing line; and a source drive IC providing a data voltage to a pixel through the sensing line and including a sensing block obtaining sensing data related to driving characteristics of the pixel using a signal input through the sensing line, wherein the source drive IC performs a calibrating operation obtaining calibration data during a display driving period for which an image is displayed on the display panel by providing the data voltage and compensates for a characteristic change of the sensing block during the display driving period in real time.

In an aspect, the source drive IC may perform a calibrating operation of obtaining the calibration data in a display driving period during which image is displayed on the display panel by providing the data voltage.

In an aspect, a reference voltage may be provided to the pixel through the sensing line by a source separate from the power source, in a part of the display driving period.

In an aspect, the switch may connect the pixel and the sensing block and the sensing block may obtain the sensing data by using a voltage or a current of the sensing line in a vertical blank period of a power off sequence period except for the display driving period.

In an aspect, the sensing block may include a sampling unit for sampling and holding a voltage of the sensing line and an analog-to-digital converter for converting the sampled voltage into a digital value, in case that the power source provides the test voltage to the sensing block.

In an aspect, the sensing block may include an integrator for integrating a current, a sampling unit for sampling and holding a voltage output from the integrator and an analog-to-digital converter for converting the sampled value into a digital value, in case that the power source provides the test current to the sensing block.

In an aspect, the display device may further comprise a controller configured to compensate input image data based on the calibration data and the sensing data and provide the compensated data to the source drive IC.

The method for calibrating data in a display device according to another aspect of the present disclosure includes displaying image by applying a data voltage to a plurality of pixels connected to data lines and sensing lines during a display driving period; obtaining calibration data for a sensing block which obtains sensing data related to driving characteristics of a pixel by providing a test voltage or a test current to the sensing block, while disconnecting a connection between the pixel and the sensing block; obtaining the sensing data by using a voltage or a current of the sensing line while connecting the pixel and the sensing block, during a period except for the display driving period; and compensating input image data based on the calibration data and the sensing data.

In an aspect, the obtaining calibration data may be performed in the display driving period.

In an aspect, the displaying image may comprise providing a reference voltage separate from the test voltage to the pixel through the sensing line in a part of the display driving period.

In an aspect, the obtaining the sensing data may be performed in a vertical blank period or a power off sequence period.

Accordingly, the calibrating operation can be performed simultaneously with the display driving, so that the change of the sensing blocks due to the environmental change caused by the display driving can be calibrated and compensated in real time and it is possible to reduce the deviation between the source drive ICs in real time, thereby improving the block dim phenomenon and improving the image quality.

Furthermore, by performing the calibrating operation during the display driving period, it is possible to reduce the time required for the power-off sequence.

BRIEF DESCRIPTION OF THE DRAWINGS

The accompanying drawings, which are included to provide a further understanding of the disclosure and are incorporated in and constitute a part of this application, illustrate aspects of the disclosure and together with the description serve to explain the principles of the disclosure.

In the drawings.

DETAILED DESCRIPTION

Figure 1:
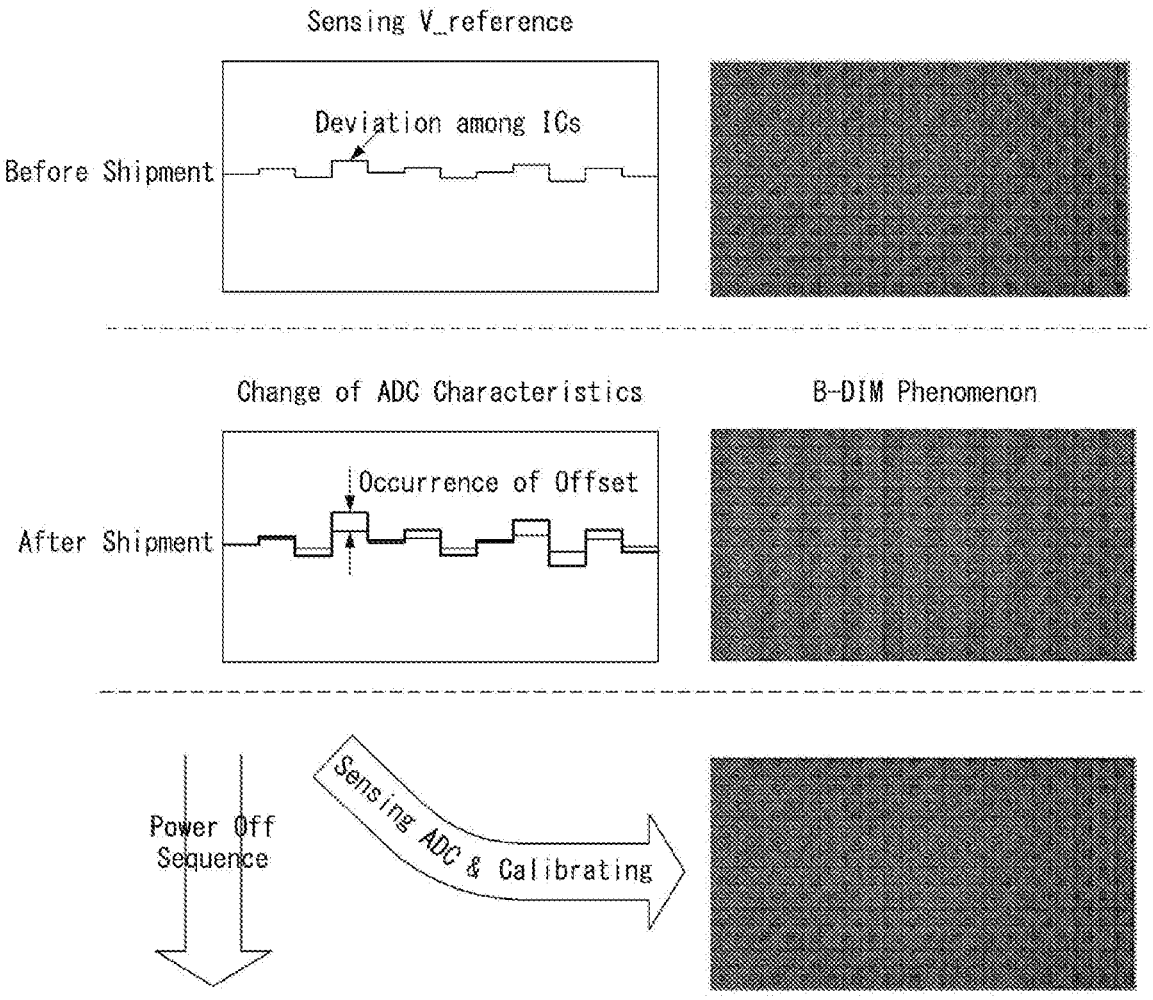
FIG. 1 RELATED ART
FIG. 1 schematically illustrates a technique for performing a calibration to eliminate a block dim phenomenon caused by a change in ADC characteristics after shipment.
Figure 2:
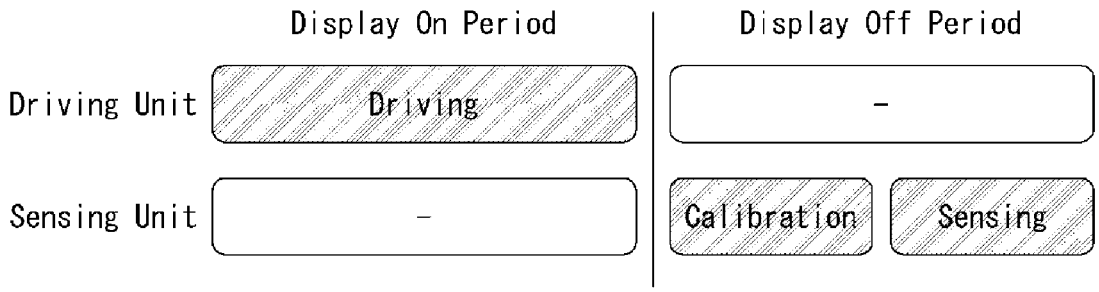
FIG. 2 RELATED ART
FIG. 2 shows an operation of a display device in which a period during which a driving unit performs display driving and a period during which a sensing unit performs a calibrating operation and a sensing operation are performed separately in the related art.

Hereinafter, aspects of the present disclosure will be described in detail with reference to the accompanying drawings. Same reference numerals throughout the specification denote substantially identical components. In the following description, a detailed description of known functions and configurations incorporated herein will be omitted when it may make the subject matter of the present disclosure rather unclear.

Figure 3:
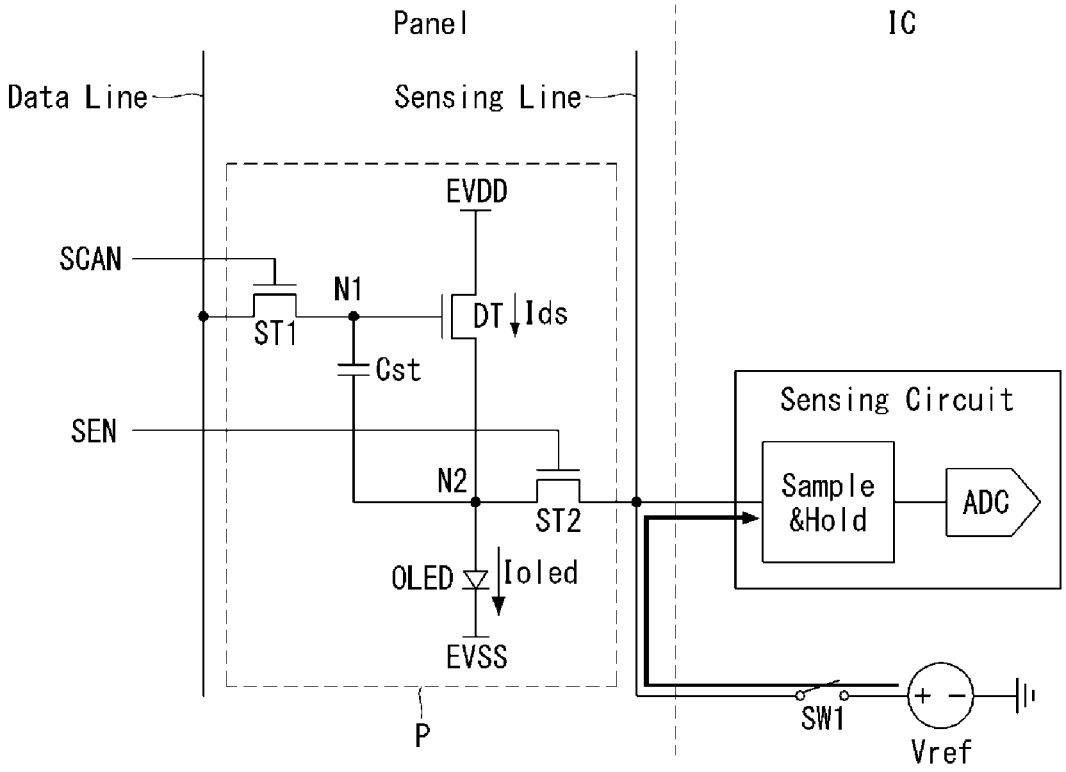
FIG. 3 illustrates a circuit that provides a reference voltage that is provided to a pixel for calibrating a sensing circuit to a sensing block.

FIG. 3 illustrates a circuit that provides a reference voltage that is provided to a pixel for calibrating a sensing circuit to a sensing block.

Each of a plurality of pixels constituting a display panel is connected to a data line for applying a data voltage and a sensing line for transferring the signal reflecting pixel characteristics. A pixel of OLED comprises a driving TFT DT for controlling a current driving the OLED, a first and second TFTs ST1 and ST2 for controlling the operations of the driving TFT, and a storage capacitor Cst for storing a data voltage to be applied to the driving TFT. A scan signal SCAN and a sensing signal SEN control the operations of the first and second TFTs ST1 and ST2. A source drive IC includes a sensing circuit (or a sensing block) connected to the pixel through the sensing line in order to sense the driving characteristics of the pixel. A reference voltage source Vref applies a reference voltage to the pixel through the sensing line, and provides the test voltage for calibrating the sensing circuit to the sensing line.

During a part of the display driving period during which a data voltage is applied through the data line and the driving TFT is turned on to flow a current through the OLED so the OLED emits light, that is before and/or during the data voltage is applied to a gate of the driving TFT, the reference voltage source Vref applies the reference voltage to a source of the driving TFT through the sensing line.

During the display driving period, the reference voltage source is connected to pixels of at least one pixel line through the sensing line, and a part of the current flowing through the driving TFT of the pixel is applied to the reference voltage source through the sensing line to cause a change in the reference voltage. As such, during the display driving period the output voltage of the reference voltage source fluctuates due to the pixel current flowing through the sensing line.

The calibrating operation of the sensing block is performed by using the output voltage of the reference voltage source as a test voltage. But, since the test voltage may not be constant and fluctuate during the display driving period, the calibrating operation cannot be performed during the display driving period and can be performed in a vertical blank period or a power off period except for the display driving period.

When only a mobility of the driving TFT is compensated, there is no problem since the reference voltage source is not influenced by the pixel current even if the calibrating operation is performed during the display driving period. However, when both of the threshold voltage and the mobility of the driving TFT are to be compensated, the calibrating operation cannot be performed since the reference voltage source is influenced by the pixel current during the display driving period. If the calibrating operation is performed, an offset deviation occurs among the source drive ICs and the block dim phenomenon will occur.

Therefore, in the present disclosure, the sensing block of the source drive IC is separated from the panel including the pixels during the display driving period, and the calibrating operation for the sensing block is performed using a power source separate from the reference voltage source applying a reference voltage to the sensing block during the display driving period so that the display operation for displaying input image data and the calibrating operation for measuring the offset deviation of the sensing blocks can be performed at the same time.

Figure 4:
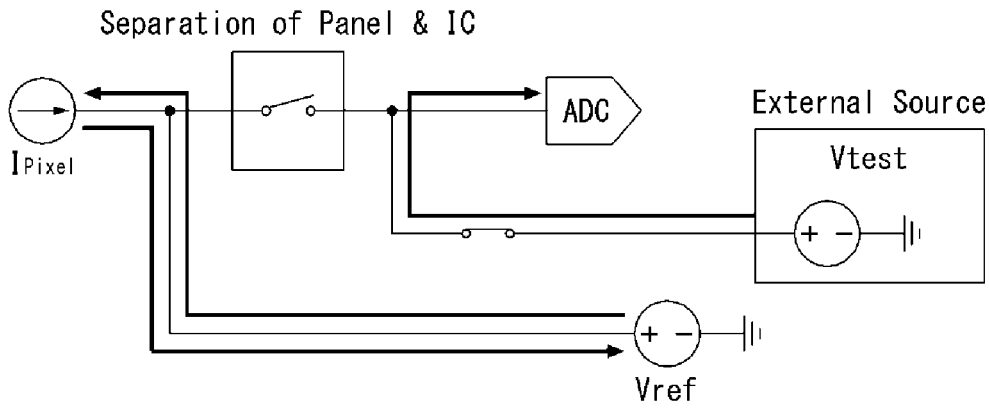
FIG. 4 schematically illustrates that a reference voltage is provided by separating a panel and a source drive IC according to an aspect of the present disclosure.
Figure 5:
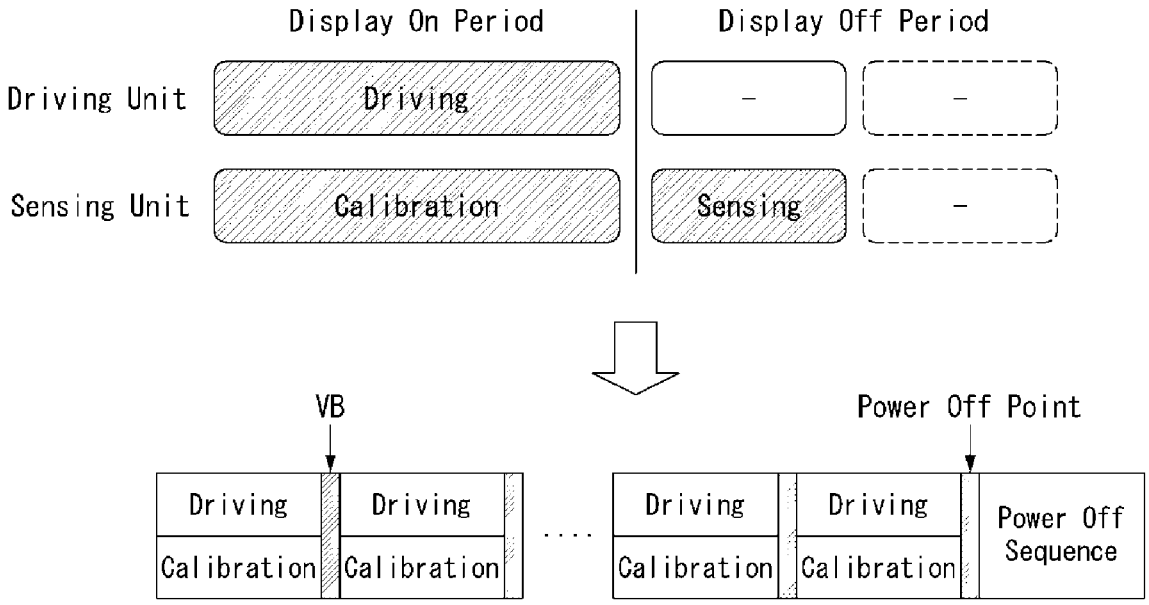
FIG. 5 schematically illustrates that a display driving and a calibrating operation are performed in parallel according to an aspect of the present disclosure.

FIG. 4 schematically illustrates that a reference voltage is provided by separating a panel and a source drive IC according to an aspect of the present disclosure, and FIG. 5 schematically illustrates that the display driving and the calibrating operation are performed in parallel according to an aspect of the present disclosure.

As shown in FIG. 4, the panel part, including a pixel and the reference voltage source Vref providing a reference voltage for initializing the source node of the driving TFT included in the pixel, and the source drive IC, including the sensing block ADC for sensing the pixel current Ipixel reflecting the driving characteristics of the pixels, are separated by a switch, and the test voltage source Vref2 separate from the reference voltage source is connected to the sensing block, so the calibrating operation for the sensing block can be performed with an independent power source that is not affected by the pixel current Ipixel and the reference voltage applied to the pixel.

The display panel including the pixel and the reference voltage source, and the source drive IC including the sensing block and the test voltage source, are separated from each other, as shown in FIG. 5, by independently performing the display driving, which applies the data voltage corresponding to image data to pixels, and the calibrating operation, which senses the characteristics of the sensing block using a separate test voltage source, in parallel in a display-on interval. Thus, it is possible to perform the sensing drive for detecting the driving characteristics of the pixel immediately after a power-off without performing the calibrating operation, and it is possible to reduce the time required to perform a power-off sequence.

Figure 6:
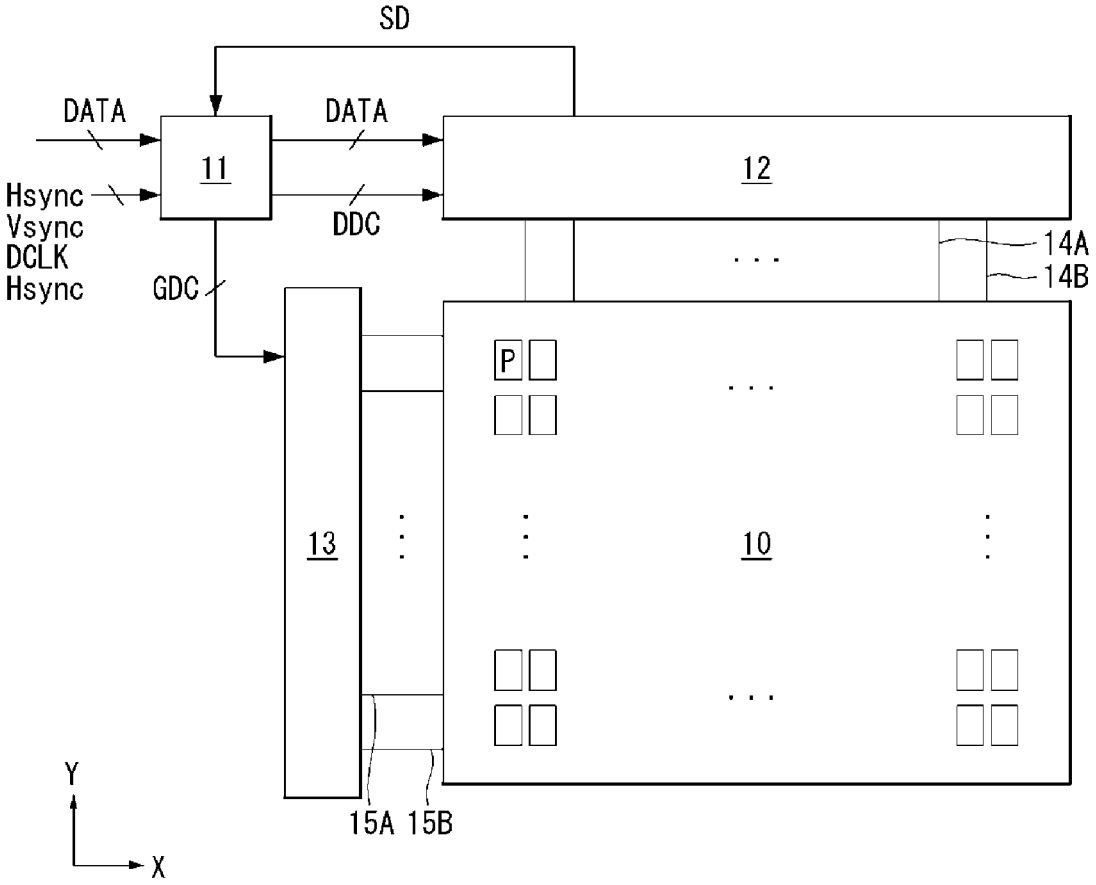
FIG. 6 shows a driving circuit of a display device as blocks according to an aspect of the present disclosure.

FIG. 6 shows the driving circuit of the display device as blocks according to an aspect of the present disclosure.

The display device according to the present disclosure comprises a display panel 10, a timing controller 11, a data driving circuit 12 and a gate driving circuit 13.

Figure 7:
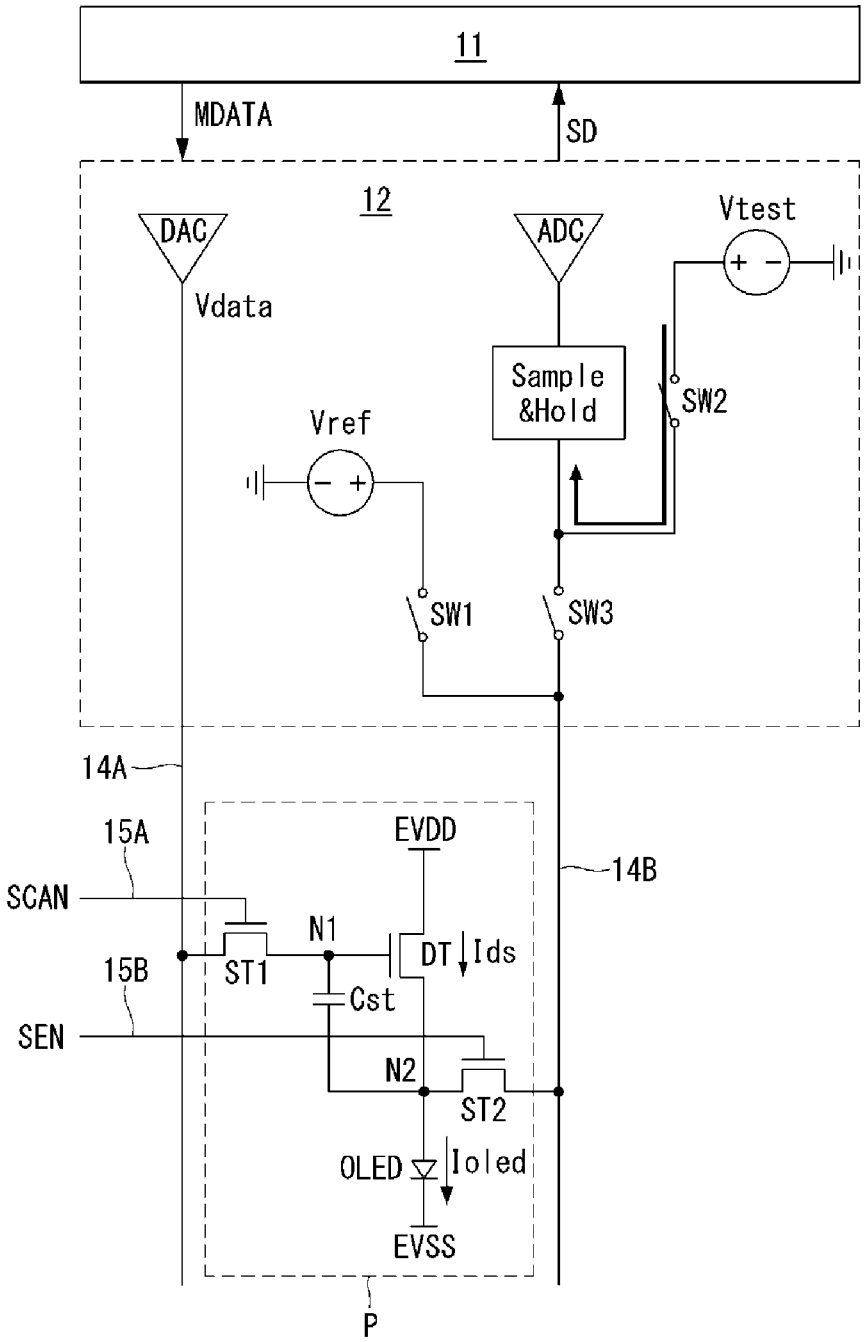
FIG. 7 illustrates a circuit configuration for performing the calibrating operation using a voltage source as an external source according to an aspect of the present disclosure.

A plurality of data lines 14 and a plurality of sensing lines and a plurality of gate lines (or scan lines) 15 cross each other on the display panel 10, and the pixels P are arranged in a matrix form to constitute a pixel array. The plurality of gate lines 15 may include a plurality of first gate lines 15A to which first scan signals SCAN are supplied and a plurality of second gate lines 15B to which second scan signals SEN are supplied as shown in FIG. 7.

The pixel P is connected to any one of the data lines 14A, any one of the sensing lines 14B, any one of the first gate lines 15A, and any one of the second gate lines 15B to constitute a pixel line. The pixel P is electrically connected to the data line 14A in response to a first scan pulse input through the first gate line 15A and receives a data voltage. The pixel P may output a sensing signal through the sensing line 14B in response to a second scan pulse input through the second gate line 15B. The pixels disposed in a same pixel line operate simultaneously according to the first scan pulse applied from a same first gate line 15A.

The pixel P is supplied with a high potential drive voltage EVDD and a low potential drive voltage EVSS from a not-shown power supply, and may comprise an OLED, a driving TFT, a storage capacitor, a first switch TFT and a second switch TFT. The TFTs constituting the pixel P may be implemented as a p-type or an n-type or as a hybrid type in which P-type and N-type are mixed. In addition, the semiconductor layer of the TFTs may include amorphous silicon, polysilicon, or an oxide.

In the driving circuit or the pixel of the present disclosure, the switch elements may be implemented by the transistor of an n-type metal oxide semiconductor field effect transistor MOSFET or a p-type MOSFET. The following aspects are illustrated with an n-type transistor, but the present disclosure is not limited thereto. A transistor is an element of 3 electrodes including a gate, a source and a drain. The source is an electrode for supplying a carrier to the transistor. Within the transistor the carrier begins to flow from the source. The drain is an electrode from which the carrier exits the transistor. That is, the flow of carriers in the MOSFET is from the source to the drain. In the case of an N-type MOSFET (NMOS), since the carrier is an electron, the source voltage has a voltage lower than the drain voltage so that electrons can flow from the source to the drain. In the N-type MOSFET, a current direction is from the drain to the source because electrons flow from the source to the drain. In the case of a P-type MOSFET (PMOS), since the carrier is a hole, the source voltage is higher than the drain voltage so that holes can flow from the source to the drain. In the P-type MOSFET, a current flows from the source to the drain because holes flow from the source to the drain. It should be noted that the source and drain of the MOSFET are not fixed. For example, the source and drain of the MOSFET may vary depending on the applied voltage. In the following aspects, the disclosure should not be limited due to the source and drain of the transistor.

The display device of the present disclosure adopts an external compensation scheme. The external compensation scheme senses the electrical characteristics of the driving TFT equipped in the pixel and corrects the digital data DATA of input image based on a sensing value. The electrical characteristics of the driving TFT may include the threshold voltage and the electron mobility of the driving TFT.

The timing controller 11 may temporally separate the sense driving, which senses the driving characteristics of the pixel and updates the compensation value corresponding to a sensing value, and the display operation, which writes image data RGB on the display panel 10 in order to display the input image reflecting the compensation value, according to a predetermined control sequence. That is, the sense driving can be performed in a period during which the writing of the image data stops.

Under the control of the timing controller 11, the sense driving may be performed during a vertical blank period, or during a power-on sequence period before the display operation starts (a non-display period until an image display period in which image is displayed immediately after system power is applied), or during a power-off sequence after the display operation ends (a non-display period until the system power is turned off immediately after the image display is terminated).

The vertical blank period is a period during which input image data DATA is not written and disposed between vertical active periods during which input image data of 1 frame is written. The power-on sequence period means a transient period from when the system power is turned on until the input image is displayed. The power-off sequence period means a transient period from the end of the display of the input image until the system power is turned off.

In the display driving period, the calibrating operation for measuring the offset of the sensing block may be performed by applying a separate test voltage or test current to the sensing block in parallel with applying the data voltage corresponding to image data to the pixel, under the control of the timing controller 11.

The timing controller 11 generates the data control signal DDC for controlling the operation timings of the data driving circuit 12 and the gate control signal GDC for controlling the operation timings of the gate driving circuit 13, based on timing signals, such as a vertical synchronization signal Vsync, a horizontal synchronization signal Hsync, a dot clock signal DCLK, and a data enable signal DE. The timing controller 11 may temporally separate the display driving period of performing an image display and the sense driving period of sensing pixel characteristics and differently generate the control signals for the display driving and the control signals for the sense driving.

The gate control signal GDC includes a gate start pulse GSP, a gate shift clock GSC, a gate output enable signal GOE, and the like. The gate start pulse (GSP) is applied to a gate stage that generates a first scan signal to control the gate stage to generate the first scan signal. The gate shift clock GSC is a clock signal commonly input to the gate stages, and is a clock signal for shifting the gate start pulse GSP. The gate output enable signal GOE is a masking signal that controls the output of the gate stages.

The data control signal DDC includes a source start pulse SSP, a source sampling clock SSC, a source output enable signal SOE, and the like. The source start pulse SSP controls the data sampling start timing of the data driving circuit 12. The source sampling clock SSC is a clock signal that controls the sampling timings of data in respective source drive ICs on the basis of a rising or falling edge. The source output enable signal SOE controls the output timing of the data driving circuit 12.

During the calibrating operation, the timing controller 11 may calculate the compensation value for calibrating, which can compensate the offset deviation among the sensing blocks, based on the sensing data for calibrating which is input from the data driving circuit 12 and stored in a memory.

During the sense driving, the timing controller 11 may calculate the compensation value for pixel, which can compensate for the change of the driving characteristics of the pixel, based on the digital sensing value SD input from the data driving circuit 12 and stored in the memory. The compensation value for pixel stored in the memory can be updated every time the sense driving is performed, and thus the time-varying characteristics of the pixel can be easily compensated.

During the display driving, the timing controller 11 may read the compensation value for pixel from the memory, correct the digital data DATA of input image based on the compensation value for pixel, and provides it to the display driving circuit 12. The timing controller 11 may increase compensation accuracy by further referring to also the compensation value for calibrating as well as the compensation value for pixel.

The data driving circuit 12 may include one or more source drive ICs for dividing and driving the display panel 10 on an area basis. Each source drive IC may include a plurality of digital-to-analog converters DAC connected to the data lines 14A, a sensing block connected to the sensing line 14B through a sensing channel, and a separation switch for controlling the connection of the sensing line 14B and the sensing block. The test voltage or current may be applied to the sensing block from a test power source.

During the display driving, the DAC converts the digital image data RGB input from the timing controller 11 into the data voltage for display according to the data control signal DDC and provides the data voltage to the data lines 14A. The data voltage for display is a voltage that varies depending on the gray level of input image.

During the sense driving, the DAC generates the data voltage for sensing according to the data control signal DDC and provides the data voltage to the data lines 14A. The data voltage for sensing is a voltage that can turn on the driving TFT equipped in the pixel during the sense driving. The data voltage for sensing may be generated as a same value for all pixels. Given that the pixel characteristics are different for each color, the data voltage for sensing may be generated with different values for each color. For example, the data voltage for sensing may be generated as a first value for first pixels displaying a first color, as a second value for second pixels displaying a second color and as a third value for third pixels displaying a third color.

The separation switch disconnects the sensing line 14B from the sensing block at the time of the display driving and connects the sensing line 14B with the sensing block at the time of the sense driving, according to the data control signal DDC.

The test power source is connected to the sensing block to provide the test voltage or the test current during the calibrating operation (during the display driving), and is disconnected from the sensing block during the sense driving.

The seeing block may comprise a plurality of sensing units and an ADC sequentially connected to the sensing units. The plurality of sensing units samples the signal reflecting the driving characteristics of pixel input through the sensing line during the sense driving and samples the test signal input from the test power source during the calibrating operation.

The ADC outputs the sensing data corresponding to the driving characteristics of pixel during the sense driving and outputs the sensing data for calibrating corresponding to the test signal during the calibrating operation.

The gate driving circuit 13 generates the scan signals for display SCAN based on the gate control signal GDC and sequentially provides the scan signals to the first gate lines 15A connected to the pixel lines. The pixel line means a set of horizontally adjacent pixels. The scan signals swing between a gate high voltage VGH and a gate low voltage VGL. The gate high voltage VGH is set to a voltage higher than a threshold voltage of a TFT to turn the TFT on, and the gate low voltage VGL is lower than the threshold voltage of the TFT.

The gate driving circuit 13 generates the scan pulses for sensing SEN based on the gate control signal GDC and sequentially provides the scan pulses to the gate lines 15B connected to the pixel lines, during the sense driving. The scan pulses for sensing may have a wider on-pulse interval than the scan pulses for display. One or more on-pulse intervals of the gate pulses for sensing may be included within one line sensing on-time. Here, the one line sensing on-time means the scan time taken to simultaneously sense the pixels of one pixel line.

The OLED display device will be mainly described as a display device to which the present disclosure is applied, but the display device of the present disclosure is not limited thereto. For example, the display device of the present disclosure can be applied to any display device, for example, a liquid crystal display LCD or an inorganic light emitting display device using an inorganic substance as a light emitting layer, which needs to sense driving characteristics of pixels in order to increase the reliability and life of the display device.

FIG. 7 illustrates a circuit configuration for performing the calibrating operation using a voltage source as an external source according to an aspect of the present disclosure.

Referring to FIG. 7, the pixel P of the present disclosure may comprise an OLED, a driving TFT DT, a storage capacitor Cst, a first switch TFT ST1 and a second switch TFT ST2.

The OLED includes an anode electrode connected to the source node of the driving TFT DT, a cathode electrode connected to the input terminal of a low potential drive voltage EVSS and organic compound layers located between the anode electrode and the cathode electrode. The driving TFT DT controls the amount of the current input to the OLED according to the voltage Vgs between a gate electrode and a source electrode. The gate electrode of the driving TFT DT is connected to a gate node N1, the drain electrode of the driving TFT DT is connected to the input terminal of a high potential drive voltage EVDD, and the source electrode of the driving TFT DT is connected to the source node N2. The storage capacitor Cst is connected between the gate node N1 and the source node N2. The first switch TFT SW1 applies the data voltage Vdata in the data line 14A to the gate node N1 in response to the first scan signal SCAN. The gate electrode of the first switch TFT SW1 is connected to the first scan line 15A, the drain electrode of the first switch TFT SW1 is connected to the data line 14A and the source electrode of the first switch TFT SW1 is connected to the gate node N1. The second switch TFT SW2 turns on/off the current flow between the source node N2 and the sensing line 14B in response to the second scan signal SEN. The gate electrode of the second switch TFT SW2 is connected to the second gate line 15B, the drain electrode of the second switch TFT SW2 is connected to the sensing line 14B and the source electrode of the second switch TFT SW2 is connected to the source node N2.

The source drive IC 12 constituting the data driving circuit is connected to the pixels through the data lines 14A and the sensing lines 14B. The source drive IC 12 may include a digital-to-analog converter DAC for converting digital compensation data MDATA into a data voltage for display Vdata, a sample/holder for sampling and holding an analog sensing voltage during the sense driving and a test voltage during the calibrating operation, a ADC for converting the sampled sensing voltage or sampled test voltage into a digital sensing value or a digital test value, and a third switch SW3 for disconnecting during the display driving and connecting during the sense driving.

The source drive IC 12 may further include a first switch SW1 for controlling the connection between the reference voltage source Vref providing a reference voltage and the sensing line 14B and a second switch SW2 for controlling the connection between the test voltage source providing the test voltage and the sample/holder. The sample/holder, the ADC, the second switch SW2 and the third switch SW3 may be referred to as a sensing block and the sample/holder, the second switch SW2 and the third switch SW3 may be referred to as a sensing unit.

The test voltage source Vtest may have a same output voltage as the reference voltage source Vref, and may be used as an external source separated from the reference voltage source Vref fluctuating according to the data voltage applied to a pixel.

The first switch SW1 is connected to and provides a reference voltage to the sensing line 14B during the display driving and is disconnected to the sensing line 14B during the sense driving. During the display driving, individual pixels are sequentially connected to the sensing lines 14B in synchronization with the second scan signal SEN and the source node N2 of the driving TFT DT is initialized.

The second switch SW2 connects the reference voltage source Vref and the sample/holder to perform the calibrating operation during the display driving and disconnects the reference voltage source Vref and the sample/holder during the sense driving.

The third switch SW3 disconnects the connection between the sensing block and a pixel (or the sensing line 14B) during the display driving, and the sensing block performs a calibrating operation using the voltage of the test voltage source Vtest to output the sensing data for calibrating corresponding to the characteristics of the sensing block. And, the third switch SW3 connects the sensing block and a pixel during the sense driving, so the sensing block outputs the sensing data reflecting the driving characteristics of the pixel using the signal applied through the sensing line 14B.

Figure 8:
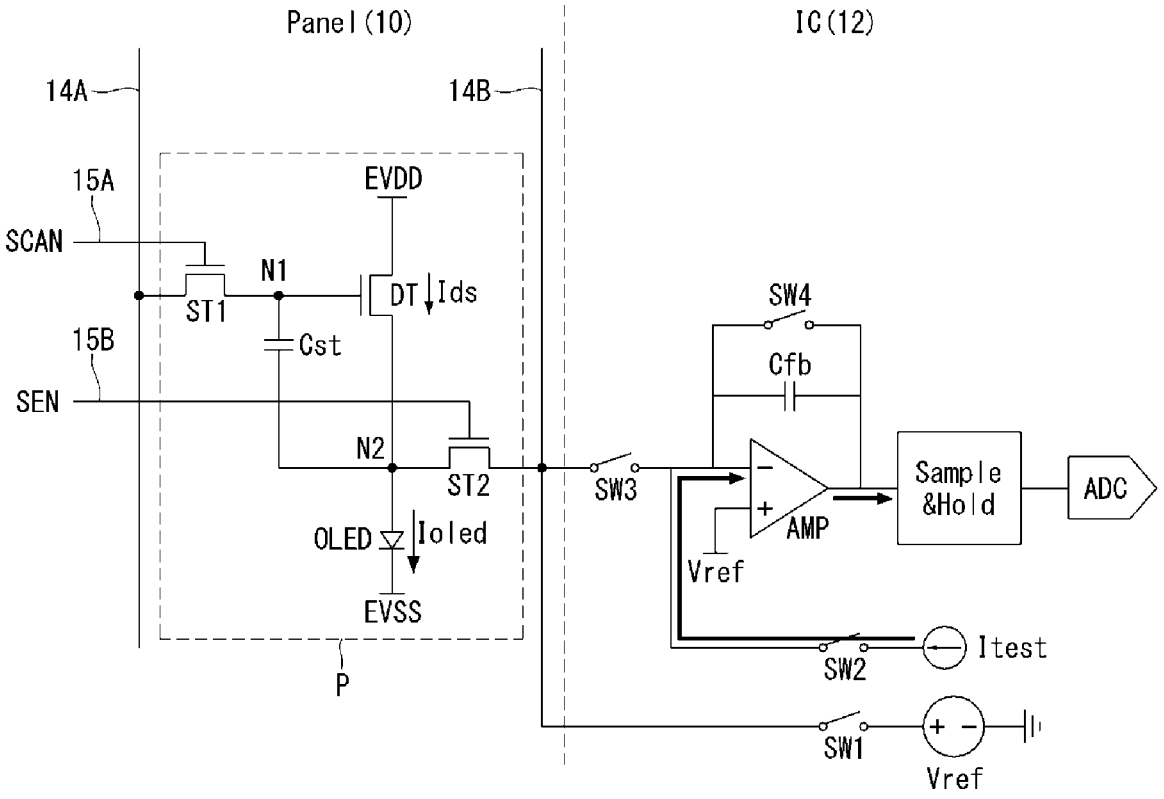
FIG. 8 illustrates a circuit configuration for performing the calibrating operation using a current source as an external source according to another aspect of the present disclosure.

FIG. 8 illustrates a circuit configuration for performing the calibrating operation using a current source as an external source according to another aspect of the present disclosure.

The pixel configuration of FIG. 8 is the same as that of FIG. 7, so the description thereabout is omitted.

In FIG. 8, the sensing block outputs the current input from a pixel or the test current input from a test source as sensing data or the sensing data for calibrating, so different from the sensing block of FIG. 7. Especially, the configuration that a current integrator for converting the current into a voltage is disposed before the sample/holder and a test current source Itest is used instead of the test voltage source Vtest is different from FIG. 7.

The current integrator comprises an operational amplifier AMP, a feedback capacitor Cfb and a fourth switch SW4. The current integrator integrates the pixel current input to the sensing block through the sensing line 14B or the test current and outputs the integral value. The operational amplifier AMP includes an inverting terminal (−) receiving the pixel current or the test current, a non-inverting terminal (+) receiving a reference voltage Vref and an output terminal outputting an integral value. The feedback capacitor Cfb connects the non-inverting terminal (+) and the output terminal and integrates the current. The fourth switch SW4 is connected to both ends of the feedback capacitor Cfb and the feedback capacitor Cfb is initialized when the fourth switch SW4 is turned on.

During the display driving, the third switch SW3 is turned off to separate the sensing block and the pixel, and turned on to apply the reference voltage Vref to the sensing line 14B. During an initialization section of the display driving, the fourth switch SW4 is turned on, and the operational amplifier AMP operates as a buffer whose gain is one, so the input terminals (+) and (−) and the output terminal are all initialized to be the reference voltage Vref. After the initialization section, the second switch SW2 is turned on and the fourth switch SW4 is turned off, so the test current from the test current source Itest is applied to the inverting terminal (−) of the operational amplifier AMP and the operational amplifier AMP operates as a current integrator to integrate the test current.

That is, after the initialization section of the display driving, a potential difference is generated across the feedback capacitor Cfb due to the test current flowing to the inverting terminal (−) of the operational amplifier AMP and the potential of the output terminal of the operational amplifier AMP is lowered with response to the potential difference across the feedback capacitor Cfb. With this principle, the output value of the current integrator changes to an integral value via the feedback capacitor Cfb. The output value of the current integrator is sampled by the sample&holder and converted into the sensing value for calibrating by the ADC to be transferred to the timing controller 11. The sensing value for calibrating may be used to calculate the compensation value for calibrating for compensating the offset deviation among the sensing blocks by the timing controller 11.

Meanwhile, during the sense driving, the third switch SW3 is turned on to connect the sensing block and the pixel, and the first and second switches SW1 and SW2 are turned off.

During an initialization section of the sense driving, the fourth switch SW4 is turned on and the operational amplifier AMP operates as a buffer whose gain is one, so the input terminals (+) and (−) and the output terminal of the operational amplifier AMP, the sensing line 14B and the node N2 are all initialized to be the reference voltage Vref. During the initialization section, the data voltage for sensing is applied to the gate node N1 of the pixel through the DAC of the source drive IC 12, accordingly the pixel current corresponding to the potential difference (Vdata−Vref) between the gate node N1 and the source node N2 flows through the driving TFT DT. But, since the operational amplifier AMP continuously operates as a buffer whose gain is one, the output value of the current integrator maintains the reference voltage Vref.

After the initialization section of the sense driving, the fourth switch SW4 is turned off, so the pixel current from the pixel is applied to the inverting terminal (−) of the operational amplifier AMP and the operational amplifier AMP operates as a current integrator to integrate the pixel current. A potential difference is generated across the feedback capacitor Cfb due to the pixel current flowing to the inverting terminal (−) of the operational amplifier AMP, the potential of the output terminal of the operational amplifier AMP is lowered with response to the potential difference across the feedback capacitor Cfb, and the output value of the current integrator changes to an integral value via the feedback capacitor Cfb. The output value of the current integrator is sampled by the sample&holder and converted into the sensing value for pixel by the ADC to be transferred to the timing controller 11. The sensing value for pixel may be used to calculate the deviation of the threshold voltage and the mobility of the driving TFT DT by the timing controller 11.

Thus, the present disclosure separates the sensing block and the pixel by a switch and uses a separate power source for the calibrating operation of the sensing blocks, which makes it possible to perform the calibrating operation in parallel with a display operation during the display driving. So it is possible to detect and compensate the characteristic change of the sensing blocks which occurs during the display driving in real time, thereby improving the block dim phenomenon and improving the image quality. Also, the calibrating operation can be omitted from the power off sequence, it is possible to reduce the time required for the power-off sequence.

Throughout the description, it should be understood by those skilled in the art that various changes and modifications are possible without departing from the technical principles of the present disclosure. Therefore, the technical scope of the present disclosure is not limited to the detailed descriptions in this specification but should be defined by the scope of the appended claims.

What is claimed is:

1. A display device, comprising:

a display panel having a plurality of pixels connected to a data line and a sensing line;

a source drive IC configured to provide a data voltage to a pixel through the data line and including a sensing block obtaining sensing data related to driving characteristics of the pixel using a signal input through the sensing line;

a reference voltage source providing a reference voltage to the sensing block; and a test power source providing a test voltage or a test current to the sensing block, wherein the source drive IC obtains calibration data related to characteristic of the sensing block by using the test voltage or the test current in a state that the switch disconnects the pixel and the sensing block, wherein the source drive IC performs a calibrating operation for obtaining the calibration data in a display driving period during which image is displayed on the display panel by providing the data voltage, wherein the sensing block performs a sensing operation to obtain the sensing data during a sensing operation period by using the test voltage or the test current in a state that the switch connects the pixel and the sensing block in a vertical blank period or a power off sequence period except for the display driving period, and wherein the sensing block includes:

a first switch connecting the reference voltage source and the sensing line during the display driving period and disconnecting the reference voltage source and the sensing line during the sensing operation period, a second switch connecting the test power source and the sensing block to perform a calibrating operation during the display driving period and disconnecting the test power source and the sensing block during the sensing operation period, and a third switch connecting the sensing block and the sensing line during the sensing operation period and disconnecting the sensing block and the sensing line during the display driving period.

2. The display device of claim 1, wherein the pixel is supplied with the reference voltage through the sensing line by the reference voltage source separate from the test power source during a part of the display driving period.

3. The display device of claim 1, wherein the third switch connects the pixel and the sensing block and the sensing block obtains the sensing data by using a voltage or a current of the sensing line during the vertical blank period or the power off sequence period except for the display driving period.

4. The display device of claim 1, wherein the sensing block includes a sampling unit sampling and holding a voltage of the sensing line and an analog-to-digital converter converting the sampled voltage into a digital value when the power source provides the test voltage to the sensing block.

5. The display device of claim 1, wherein the sensing block includes an integrator integrating a current, a sampling unit sampling and holding a voltage output from the integrator and an analog-to-digital converter converting the sampled value into a digital value when the power source provides the test current to the sensing block.

6. The display device of claim 1, further comprising a controller configured to compensate input image data based on the calibration data and the sensing data and provide the compensated data to the source drive IC.

7. A method for calibrating data in a display device having a sensing block with first, second and third switches, comprising:

displaying an image by applying a data voltage to a plurality of pixels connected to a data line and a sensing line in a display driving period;

obtaining calibration data related to characteristic of a sensing block which obtains sensing data related to driving characteristics of a pixel by providing a test voltage or a test current to the sensing block, while disconnecting a connection between the pixel and the sensing block during the display driving period;

obtaining the sensing data by using a voltage or a current of the sensing line while connecting the pixel and the sensing block during a vertical blank period or a power off sequence period except for the display driving period; and compensating for input image data based on the calibration data and the sensing data, wherein the first switch connects a reference voltage source and the sensing line during the display driving period and disconnects the reference voltage source and the sensing line during the sensing operation period, the second switch connects a test power source and the sensing block to perform a calibrating operation during the display driving period and disconnects the test power source and the sensing block during the sensing operation period, and the third switch connects the sensing block and the sensing line during the sensing operation period and disconnects the sensing block and the sensing line during the display driving period.

8. The method of claim 7, wherein the displaying image comprises providing a reference voltage separate from the test voltage to the pixel through the sensing line during a part of the display driving period.

9. A display device, comprising:

a display panel having a plurality of pixels connected to a data line and a sensing line; and a source drive IC providing a data voltage to a pixel through the data line and including a sensing block obtaining sensing data related to driving characteristics of the pixel using a signal input through the sensing line; and wherein the source drive IC performs a calibrating operation obtaining calibration data related to characteristic of the sensing block during a display driving period for which an image is displayed on the display panel by providing the data voltage and compensates for a characteristic change of the sensing block during the display driving period in real time, wherein the sensing block performs a sensing operation to obtain the sensing data by using a voltage or a current of the sensing line in a vertical blank period or a power off sequence period except for the display driving period, and wherein the sensing block includes:

a first switch connecting a reference voltage source and the sensing line during the display driving period and disconnecting the reference voltage source and the sensing line during the sensing operation period, a second switch connecting a test power source and the sensing block to perform a calibrating operation during the display driving period and disconnecting the test power source and the sensing block during the sensing operation period, and a third switch connecting the sensing block and the sensing line during the sensing operation period and disconnecting the sensing block and the sensing line during the display driving period.

10. The display device of claim 9, wherein the test power source provides a test voltage or a test current to the sensing block.

11. The display device of claim 10, wherein the pixel is supplied with a reference voltage through the sensing line by the reference voltage source separate from the test power source during a part of the display driving period.

12. The display device of claim 9, wherein the third switch controlling a connection of the sensing line between the pixel and the sensing block.

13. The display device of claim 12, wherein the third switch connects the pixel and the sensing block and the sensing block obtains the sensing data by using a voltage or a current of the sensing line during the vertical blank period or the power off sequence period except for the display driving period.

14. The display device of claim 9, wherein the calibrating operation is omitted from a power off sequence to reduce a time required for the power-off sequence.

15. The display device of claim 9, wherein the sensing block includes a sampling unit sampling and holding a voltage of the sensing line and an analog-to-digital converter converting the sampled voltage into a digital value when the power source provides the test voltage to the sensing block.

16. The display device of claim 9, wherein the sensing block includes an integrator integrating a current, a sampling unit sampling and holding a voltage output from the integrator and an analog-to-digital converter converting the sampled value into a digital value when the power source provides the test current to the sensing block.

17. The display device of claim 9, further comprising a controller configured to compensate input image data based on the calibration data and the sensing data and provide the compensated data to the source drive IC.

* * * * *